US007975523B2

(12) United States Patent
Schneider

(10) Patent No.: US 7,975,523 B2
(45) Date of Patent: Jul. 12, 2011

(54) ALIGNMENT RING FOR A PUNCH

(75) Inventor: Albrecht Schneider, Oberursel (DE)

(73) Assignee: Mate Precision Tooling Inc., Anoka, MN (US)

( * ) Notice: Subject to any disclaimer, the term of this patent is extended or adjusted under 35 U.S.C. 154(b) by 201 days.

(21) Appl. No.: 11/393,904

(22) Filed: Mar. 31, 2006

(65) Prior Publication Data

US 2006/0169117 A1 Aug. 3, 2006

Related U.S. Application Data

(63) Continuation of application No. PCT/US2004/031916, filed on Sep. 30, 2004.

(30) Foreign Application Priority Data

Oct. 1, 2003 (DE) ..... 203 15 143

(51) Int. Cl.
*B21D 37/00* (2006.01)

(52) U.S. Cl. ..... 72/481.1

(58) Field of Classification Search ..... 403/289, 403/290; 72/481.1–481.8; 83/698.91; 279/43.5, 279/44, 45, 86
See application file for complete search history.

(56) References Cited

U.S. PATENT DOCUMENTS

| | | | | |
|---|---|---|---|---|
| 4,217,061 | A * | 8/1980 | Eiland et al. | 403/313 |
| 5,067,845 | A * | 11/1991 | Schlueter | 403/344 |
| 5,306,096 | A | 4/1994 | Tüns et al. | |
| 5,613,693 | A * | 3/1997 | Ramunas | 403/362 |
| 5,851,084 | A | 12/1998 | Nishikawa | |
| 6,413,006 | B1 | 7/2002 | Neugart | |
| 6,880,832 | B2 | 4/2005 | DeRosa | |

FOREIGN PATENT DOCUMENTS

| | | |
|---|---|---|
| DE | 100 32 045 | 1/2002 |
| DE | 102 55 219 | 3/2004 |

OTHER PUBLICATIONS

Schneider, Machine Translation of DE10032045, Jan. 31, 2002, pp. 1-2.*

* cited by examiner

*Primary Examiner* — Teresa M Ekiert
(74) *Attorney, Agent, or Firm* — Stites & Harbison PLLC; Marvin Petry

(57) ABSTRACT

A split ring alignment ring for holding a punch has a split ring by which the alignment ring can be tightened onto the punch shaft. The alignment ring has a pair of radially aligned cut outs, on its inner circumference and are on its out circumference. A pin on the tool shaft engages the inner cut out to fix the tool against rotational movement relative to the ring. A second pin projects axially from the top of a punch point of the tool to engage the outer cut out, also to prevent rotational movement relative to the ring.

6 Claims, 2 Drawing Sheets

ALIGNMENT RING FOR A PUNCH

CROSS-REFERENCE TO RELATED APPLICATIONS

This application is a continuation of International Application No. PCT/US2004/031916, filed Sep. 30, 2004 (which is hereby incorporated by reference).

BACKGROUND OF THE INVENTION

The invention relates to a slit alignment ring for use in conjunction with a punch that has a cylindrical shaft and a punch point. The alignment ring can be placed on the shaft and in a defined axial position can be fixed, by elastic deformation by means of a clamping screw spanning the slit, relative to the punch point, in a rotational angle position which is defined by engagement of a pin, fixedly mounted on the punch, with a matching groove in the alignment ring.

The alignment ring has the function of fixing the punch with its punch point in a defined rotational angle position relative to the tool receptacle of the punching machine. It has the further function of keeping the punch in a cassette of the tool magazine. The load-bearing parts of the cassette engage the alignment ring.

In a version that has been customary in the past, the fixation of the rotational angle position of the alignment ring relative to the tool receptacle of the punching machine is effected by means of a key protruding past the surface of the alignment ring and extending radially, which must be made to engage a corresponding groove in the tool receptacle. For fixing the punch relative to the alignment ring, the latter is embodied as a clamping ring that is slit radially on one side. By means of a clamping screw that spans the slit, the slit can be narrowed by elastic deformation of the adjusting ring and at the same time the axial bore of the alignment ring can be reduced in size. In this way, the alignment ring can be firmly clamped on the shaft of the punch in any rotational angle position. However, setting a defined rotational angle position is complicated and inconvenient, especially since auxiliary devices must be used to do so. It has furthermore been found in practice that when there is a load on one side, the connection between the punch and the clamped-on alignment ring, which is made only by friction, is overstressed and yields in the circumferential direction.

SUMMARY OF THE INVENTION

To overcome this drawback, an alignment ring embodied as a clamping ring is proposed in German Patent DE 100 32 045 C2, in which, in addition to the frictional connection, a positive-engagement fixed against relative rotation is provided between the punch and the alignment ring. This connection comprises a pin, seated in the punch, that engages a groove in the radially inner end of the aforementioned key. In addition to the groove in the end of the key, or instead of this groove, there could also be at least one axial groove in the central bore of the alignment ring, as in the alignment ring of German Patent Application 102 55 219.3. In all these cases, there is the disadvantage that with a punch point that has a large punch point area, slight inaccuracies in the groove and the pin can result in major inaccuracies in the outer region of the punch point area.

To overcome this last drawback, it is known in practice, in punches with a large punch point area, to use an alignment ring with a radial groove machined into its lower surface, the groove not extending as far as the top, and a pin that fits and protrudes axially upward out of the punch point on a relatively large radius engages this groove. However, the production of such a groove with the requisite precision is quite expensive.

The object of the invention is to create an alignment ring of the type defined at the outset that is not only suitable for punches with a small punch point area but also offers optimal preconditions for exact guidance of the tool in punches with a large punch point area, and which furthermore can be produced economically, even by later modification of a simple slit ring.

The above object is attained according to the invention in that the alignment ring is provided, on both the inner and the outer circumference, with a respective cut out, of which the inner cut out is intended for cooperation with a pin protruding radially out of the shaft of a punch, and the outer cut out is intended for cooperation with a pin protruding axially out of the punch point area of a punch.

The two cut outs can be generated in a simple way, for instance by wire erosion. This makes it possible to use the same alignment ring for both small and large punching tools, without requiring a compromise in the case of large tools of major inaccuracies in terms of the rotary alignment of the punch. In comparison to an unslit ring, there is the advantage that when the clamping screw is tightened, the play in the bore is eliminated. At the same time, without additional provisions, the clamping assures that the punch is kept reliably firmly in the alignment ring that supports it.

In a preferred embodiment, the cut outs are in axial alignment with a key that aligns the alignment ring relative to the tool receptacle of a punching machine. Since this key is seated in a key groove, the amount of material that must be removed to produce the cut outs on the inner and outer circumference is less.

It is understood that a plurality of cut outs may be made on the inner circumference and/or on the outer circumference of the alignment ring, so that a given punch can be inserted into the alignment ring in different relative rotational angle positions. However, this is not necessary, since modern punching machines, for instance made by Trumpf, are capable of rotating the punch very precisely by any required angle beginning at a defined zero rotational angle position.

BRIEF DESCRIPTION OF THE DRAWINGS

Exemplary embodiments of the invention are shown in the accompanying drawings described in further detail below, wherein.

DETAILED DESCRIPTION OF THE PREFERRED EMBODIMENTS

Figure 1:
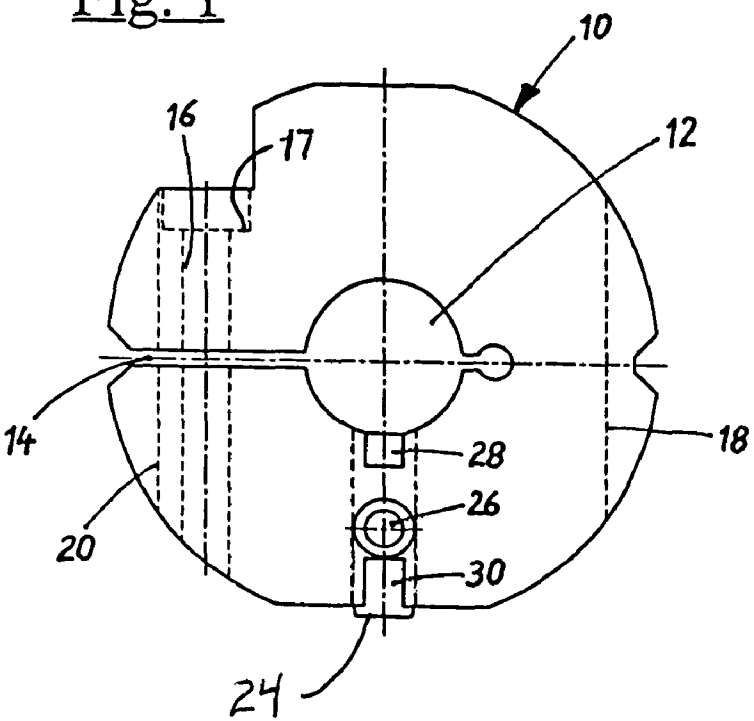
FIGS. 1 through 3 show an alignment ring, in views from below, from above, and in front elevation, respectively.
Figure 2:
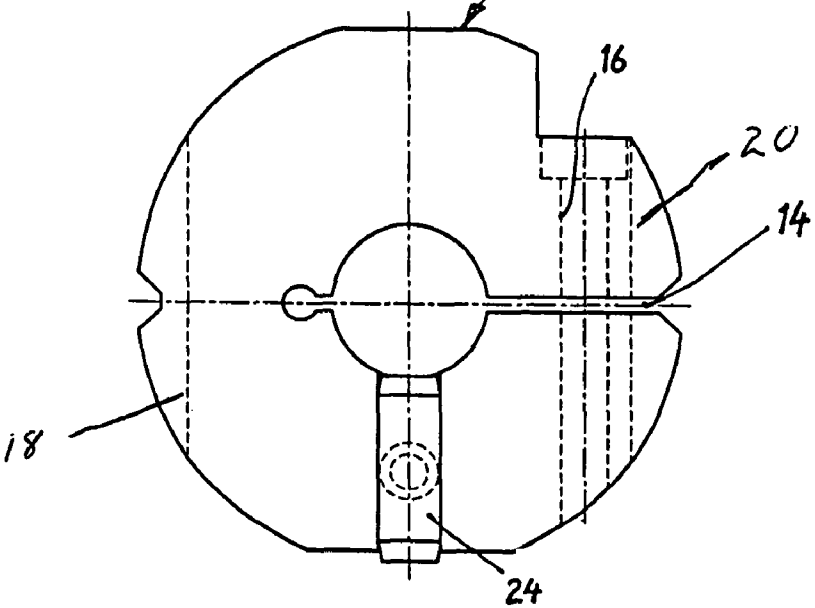
Figure 3:
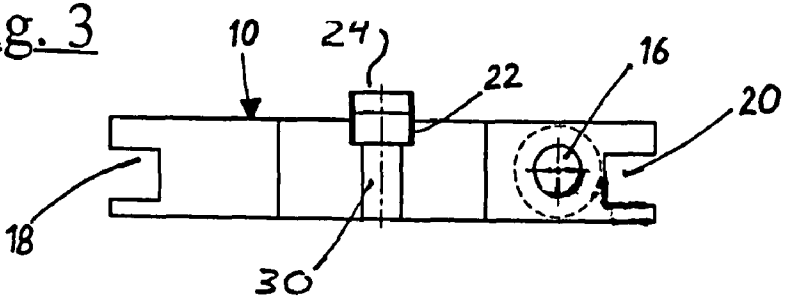

The alignment ring 10 shown in FIGS. 1 through 3 is largely equivalent to that described in German Patent DE 100 32 045 C2. It is of hardened steel and has a central bore 12 and a slit 14 which extends from the bore on one side radially outward and which is spanned by means of a clamping screw, not shown, that is seated in a bore 16 represented by dashed lines. The head of the clamping screw would sit in counterbore 17, and the bore 16 would be threaded in the portion on the opposite side of slit 14 to effect the tightening action upon turning of the screw. By tightening the clamping screw and the resultant elastic deformation of the alignment ring 10, the gap width of the slit 14 and the cross section of the bore 12 are reduced, so that in this way, the alignment ring 10 can be firmly clamped to the shaft of a punch as shown in FIGS. 4 through 7.

When the unit comprising the punch and the alignment ring firmly clamped to it is inserted into the magazine of the punching machine, spring-loaded support arms engage diametrically opposed, tangentially extending grooves 18, 20 in the outer circumferential surface. A key groove 22, extending radially and simultaneously parallel to the tangential grooves 18, 20, is also machined into the top of the alignment ring, and a key 24 of fitting width is seated in the key groove and is firmly joined to the alignment ring by a screw, not shown, that is seated in a bore 26. The key 24 protrudes upwardly beyond the upper surface of the alignment ring 10 and, in cooperation with a fitting groove in the tool receptacle, assures a defined seat, fixed against relative rotation, of the tool in the receptacle.

The special feature of the alignment ring 10 are cut outs 28 and 30 each of which extends axially from top to bottom. Cut out 28 is machined into the inner circumferential surface, that is, the circumferential wall of the central bore 12, and cut out 30 is machined into the outer circumferential surface. As FIG. 1 shows, the common radial center line of the two cut outs 28, 30 coincide with the center line of the key groove 22 and key 24. The bore 26 between the two cut outs 28, 30 also lies on the same center line, with intermediate spacing from each of them. Since the cut outs 28, 30 are narrower than the key groove 22, they penetrate it; that is, they extend between its bottom surface and the bottom face of the alignment ring. In the example shown, the inner cut out 28 is somewhat shorter, radially, than the outer cut out 30, but both have the same width in the circumferential direction.

Figure 4:
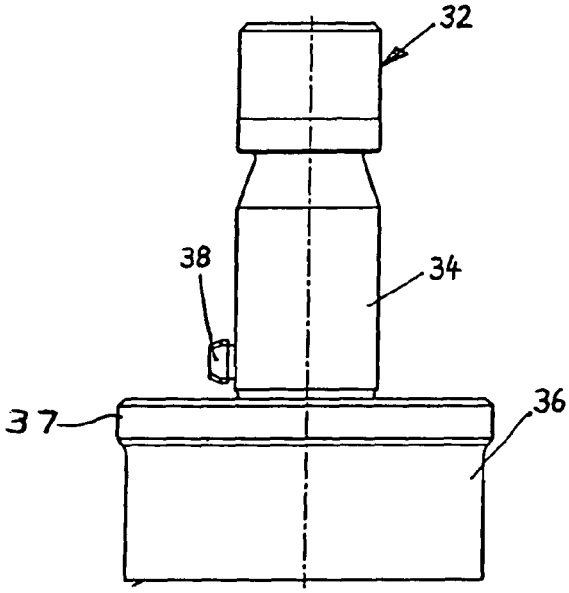
FIGS. 4 and 5 show a punch that fits the alignment ring of FIGS. 1 through 3, in two side views rotated by 90° relative to one another.
Figure 5:
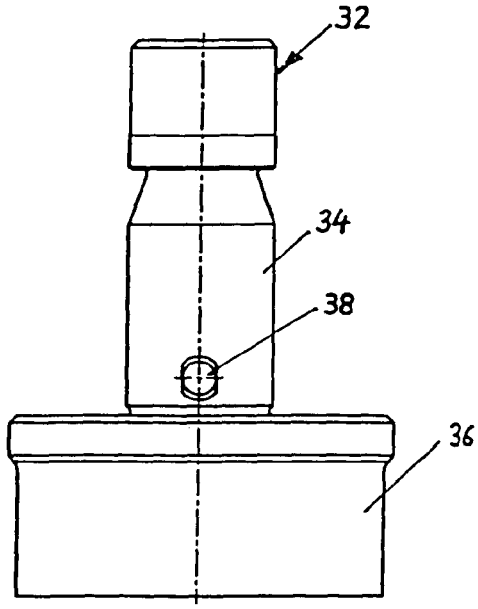

FIGS. 4 and 5 show a first punch 32, with a cylindrical shaft 34 and a punch point 36. The punch part 36 also represents a punch point area which can comprise a single cylindrical punch, as shown, or, within this area, any number of actual punch points of different shapes. This punch point area is fixed on shoulder 37. A pin 38 is seated in a radial bore in the lower region of the shaft 34 and protrudes, for instance by 3 to 5 mm, radially from the shaft 34. On its sides, it has flat flanks, and between them it has a width which matches precisely the width of the cut out 28 in the alignment ring 10. When the alignment ring is placed on the shaft 34 in that rotational angle position in which the pin 38 is seated in the cut out 28, and when the clamping screw is then tightened in the bore 16, then besides the frictional clamping, the dimensionally accurate positive engagement between the pin 38 and the cut out 28 assures an absolutely reliable connection that is fixed against relative rotation.

Figure 6:
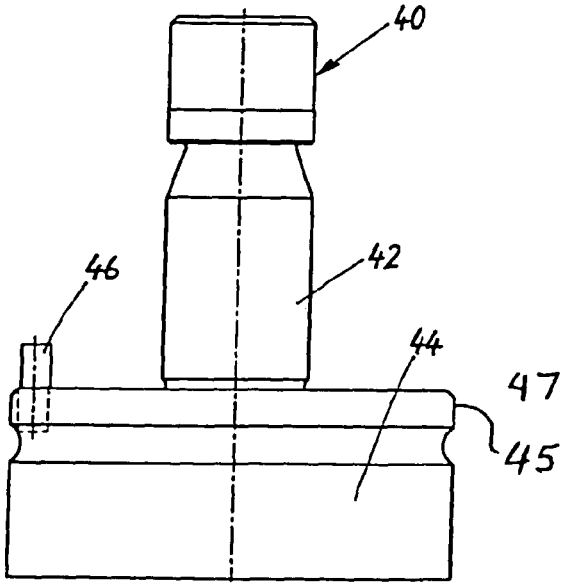
FIGS. 6 and 7 show a different punch that fits the alignment ring of FIGS. 1 through 3, in a side view and plan view, respectively.
Figure 7:
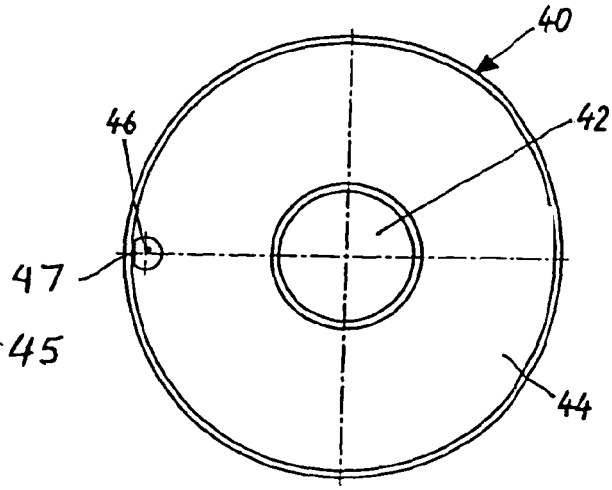

The same alignment ring shown in FIGS. 1 through 3 can also be used in conjunction with the punch 40 of FIGS. 6 and 7, whose shaft is identified by reference numeral 42 and whose punch point is identified by reference numeral 44 which is fixed to a shoulder 45. In this case, the top of the shoulder 45 is provided, in the radially outer region, with an axial bore, seated in which with a press fit is a pin 46 that protrudes vertically upward out of the shoulder 45. Expediently, this pin 46 is flattened on its outer side at 47 so that its outer periphery does not extend beyond the flat end of alignment ring 10 adjacent thereto. Upon placement of the alignment ring 10 on the shaft 42, pin 46 penetrates the outer cut out 30, whose width fits its own width precisely. It is understood that this width of the pin 46 and cut out 30 may be dimensioned differently from the width of the cut out 28 and of the pin 38. It can also be seen that because of the radial extent of the cut outs 28, 30, neither precise adherence to a particular height of the pin 38 nor a precise radial position of the pin 46 is critical. Depending on the size of the punch point area of the punch point 44, the pin 46 can therefore be seated as far outward as possible in each case, as long as it still has a hold in the cut out 30.

The invention claimed is:

1. In combination, a punch adapted for mounting on a punching machine and an alignment ring, the punch having a cylindrical shaft, one end of the punch having a structure for connection to a punching machine and the other end thereof having a punching point for punching a workpiece, the alignment ring having a top surface and a bottom surface, and having a central bore mountable on the cylindrical shaft in a fixable axial position, the alignment ring having a radial slit of a given width and a clamping device which has a structure to reduce the width of the slit to tighten the axial bore of the alignment ring onto the cylindrical shaft, the alignment ring having a first cut out on its inner periphery of a first given width in a circumferential direction for receiving a radial pin which extends radially outwardly from the cylindrical shaft and is of essentially the same width as the first given width, a second cut out at the outer periphery of the alignment ring of a second given width in the circumferential direction for receiving an axial pin extending axially upwardly from a location on the punching point, which location is spaced radially outwardly from the cylindrical shaft and of essentially the same width as the second given width, the second cut out extending from an intersection with the bottom surface upwardly toward the top surface a sufficient distance to receive the axial pin, wherein the punch may be aligned with the alignment ring by engagement of either or both of the radial pin extending into the first cut out or the axial pin extending into the second cut out.

2. The combination of claim 1, wherein the clamping device comprises a clamping screw engaging the alignment ring on both sides of the slit.

3. The combination of claim 1, wherein the center lines of the two cut outs are radially aligned.

4. The combination of claim 3, the alignment ring having a radially extending groove on its upper surface, the two cut outs being radially aligned with the groove, and a key positionable in the groove, the key extending upwardly above the upper surface of the alignment ring and adapted to align the alignment ring in a punching machine.

5. The combination of claim 4, including a securing device for securing the key in the groove.

6. The combination of claim 4, wherein the two cut outs extend axially completely through the height of the alignment ring.

* * * * *